US007946052B2

(12) United States Patent
Stevens

(10) Patent No.: US 7,946,052 B2
(45) Date of Patent: May 24, 2011

(54) CONCRETE FORM ALIGNMENT TOOL AND METHOD OF USE

(76) Inventor: George C. Stevens, Stephentown, NY (US)

( * ) Notice: Subject to any disclaimer, the term of this patent is extended or adjusted under 35 U.S.C. 154(b) by 749 days.

(21) Appl. No.: 12/013,755

(22) Filed: Jan. 14, 2008

(65) Prior Publication Data

US 2009/0179136 A1 Jul. 16, 2009

(51) Int. Cl.
*G01B 5/25* (2006.01)

(52) U.S. Cl. ..... 33/645

(58) Field of Classification Search ..... 33/613, 33/645

See application file for complete search history.

(56) References Cited

U.S. PATENT DOCUMENTS

| | | | | |
|---|---|---|---|---|
| 772,398 | A | 10/1904 | Bentley | |
| 900,517 | A | 10/1908 | Glover | |
| 1,171,491 | A | 2/1916 | Woods | |
| 1,250,956 | A | 12/1917 | Bratter | |
| 1,296,995 | A | 3/1919 | Miller | |
| 2,831,231 | A | 4/1958 | Toensing | |
| 3,024,512 | A | 3/1962 | Dyer | |
| 3,108,403 | A | 10/1963 | Jackson | |
| 3,219,308 | A | 11/1965 | Halstead | |
| 3,397,494 | A | 8/1968 | Waring | |
| 3,514,911 | A | 6/1970 | Preradovich | |
| 3,617,047 | A | 11/1971 | Holt et al. | |
| 3,956,437 | A | 5/1976 | Ellis | |
| 3,980,268 | A | 9/1976 | Ellis | |
| 4,047,356 | A | 9/1977 | DePirro | |
| 4,357,755 | A | 11/1982 | Allen et al. | |
| 4,624,439 | A | 11/1986 | Aguilera | |
| 4,625,415 | A * | 12/1986 | Diamontis | 33/613 |
| 4,749,165 | A | 6/1988 | Moraca | |
| 4,790,509 | A | 12/1988 | Cardwell et al. | |
| 5,368,269 | A | 11/1994 | Boisseau | |
| 5,785,459 | A | 7/1998 | Swinimer | |
| 5,800,727 | A | 9/1998 | Croghan | |
| 6,052,912 | A * | 4/2000 | May | 33/645 |
| 6,370,817 | B1 | 4/2002 | Brooks et al. | |
| 6,371,429 | B1 | 4/2002 | Gillespie | |
| 6,658,753 | B2 * | 12/2003 | Tatarnic | 33/613 |
| 6,874,242 | B2 * | 4/2005 | Shilo et al. | 33/645 |
| 6,945,735 | B1 | 9/2005 | Doverspike | |
| 7,131,792 | B2 | 11/2006 | Doverspike | |
| 7,726,037 | B1 * | 6/2010 | Jordan | 33/613 |
| 2002/0095813 | A1 * | 7/2002 | Tatarnic | 33/613 |
| 2010/0229415 | A1 * | 9/2010 | Knudsen | 33/613 |

FOREIGN PATENT DOCUMENTS

| | | |
|---|---|---|
| JP | 2002180661 | 6/2002 |

* cited by examiner

*Primary Examiner* — G. Bradley Bennett
(74) *Attorney, Agent, or Firm* — Schmeiser, Olsen & Watts, LLP

(57) ABSTRACT

A concrete column form aligning apparatus is useful for homeowners building decks, sheds or other structures or commercial builders making bridges, parking garages or other structures having column forms. The aligning apparatus comprises a plurality of platforms configured to engage a circumference of the concrete column form each having a securing device to fix and center each platform around the circumference of the concrete column form. Each of the apparatuses have at least one attachment bracket affixed at a predetermined angle, where the attachment brackets on each form linearly aligned at the proper angle with respect to the other attachment bracket on the other platform. A connector mechanism may be secured in the attachment bracket be using joining pieces at a designated length that secures and aligns the forms at the proper position.

17 Claims, 18 Drawing Sheets

CONCRETE FORM ALIGNMENT TOOL AND METHOD OF USE

CROSS REFERENCE TO RELATED APPLICATIONS

None

BACKGROUND OF THE INVENTION

The building of decks, sheds, etc. by the average homeowner or in a commercial construction applications such as bridge work, parking garages, and all industrial construction as well, columns made of poured concrete both above and below grade are typically aligned using plumb lines and supported with braces. Modern construction codes also may require a concrete footing at the required depth below the frost line to support the legs or base of the structure. Typically forms were set up with plumb lines and dug then braced to the ground and backfilled based upon the measurements of the lines. However, plumb lines can easily move or be repositioned because the lines may collapse or move when not under tension and therefore may shift or worse the top may tilt and while the base is properly positioned the top of the concrete column is incorrectly positioned to receive the leg of the structure. In extreme cases the cured column needs to be excavated and re-poured or in certain areas incorrect positioning has required larger sized columns than required just for top alignment purposes.

SUMMARY OF THE INVENTION

A first embodiment of the invention is a concrete column form aligning apparatus comprising: at least two platforms configured to engage a circumference of the concrete column form; a securing device to fix and center the at least two platforms around the circumference of the concrete column form; at least one attachment bracket affixed on each of the at least two platforms affixed at a predetermined angle, wherein said at least one attachment bracket is linearly aligned with one of the at least one attachment bracket on the other platform; and a connector mechanism in said at least one attachment bracket.

A second embodiment is an aligning apparatus comprising: a plurality of rings, each said ring dimensioned to surround a circumference of a concrete column forms, wherein said form quantity and positioning are designated by a construction plan; a biasing device to fix and center each said plurality of rings by engaging the circumference of the concrete column form beneath a top; and at least two attachment brackets are affixed on each of said plurality of rings at a predetermined angle from each other, said rings rotatable and stackable on said form so that said attachment brackets on each said form may be linearly aligned with one of the attachment brackets mounted on the ring upon an adjacent form; and a plurality of connector elements configured to be cut to a desired length and angle to secure between each adjacent form according to said construction plan.

A third embodiment of the invention is an aligning apparatus comprising: a plurality of alignment bases dimensioned to surround a circumference of a concrete column form and engaged below the top; a biasing device to fix and center said plurality of alignment bases at a point beneath the top of the concrete column form; and at least four attachment brackets affixed on each of said plurality of alignment bases, wherein said brackets are affixed on each said ring at a predetermined angle from each other so that one of said at least four attachment brackets may be linearly aligned with one of the brackets mounted on a base upon an adjacent form; and a connecting rod having two ends, each said end connected into said bracket on an adjacent base that is linearly aligned with respect said bracket.

A fourth embodiment of the invention is a method of aligning with said aligning apparatus comprising the steps of: providing an aligning apparatus comprising at least two bodies dimensioned to surround the concrete column form below the top, a securing device to fix and center the at least two bodies beneath the top of the concrete column form, at least one attachment bracket affixed on each of the at least two bodies, wherein said at least on attachment bracket is affixed at a predetermined angle so that the at least one attachment bracket is linearly aligned with one of the at least one attachment bracket on the other body, a connector mechanism in said at least one attachment bracket; placing at least one aligning apparatus around each support column mold; determining a proper distance between two adjacent support column molds; selecting an angle on the aligning apparatus between at least two aligning apparatuses; providing a brace at the proper length; and connecting the aligning apparatus with the brace on said attachment bracket at a proper angle and distance between the at least two aligning apparatuses.

BRIEF DESCRIPTION OF THE DRAWINGS

Some of the embodiments of this invention will be described in detail, with reference to the following figures, wherein like designations denote like members, wherein.

DETAILED DESCRIPTION OF THE INVENTION

Figure 1:
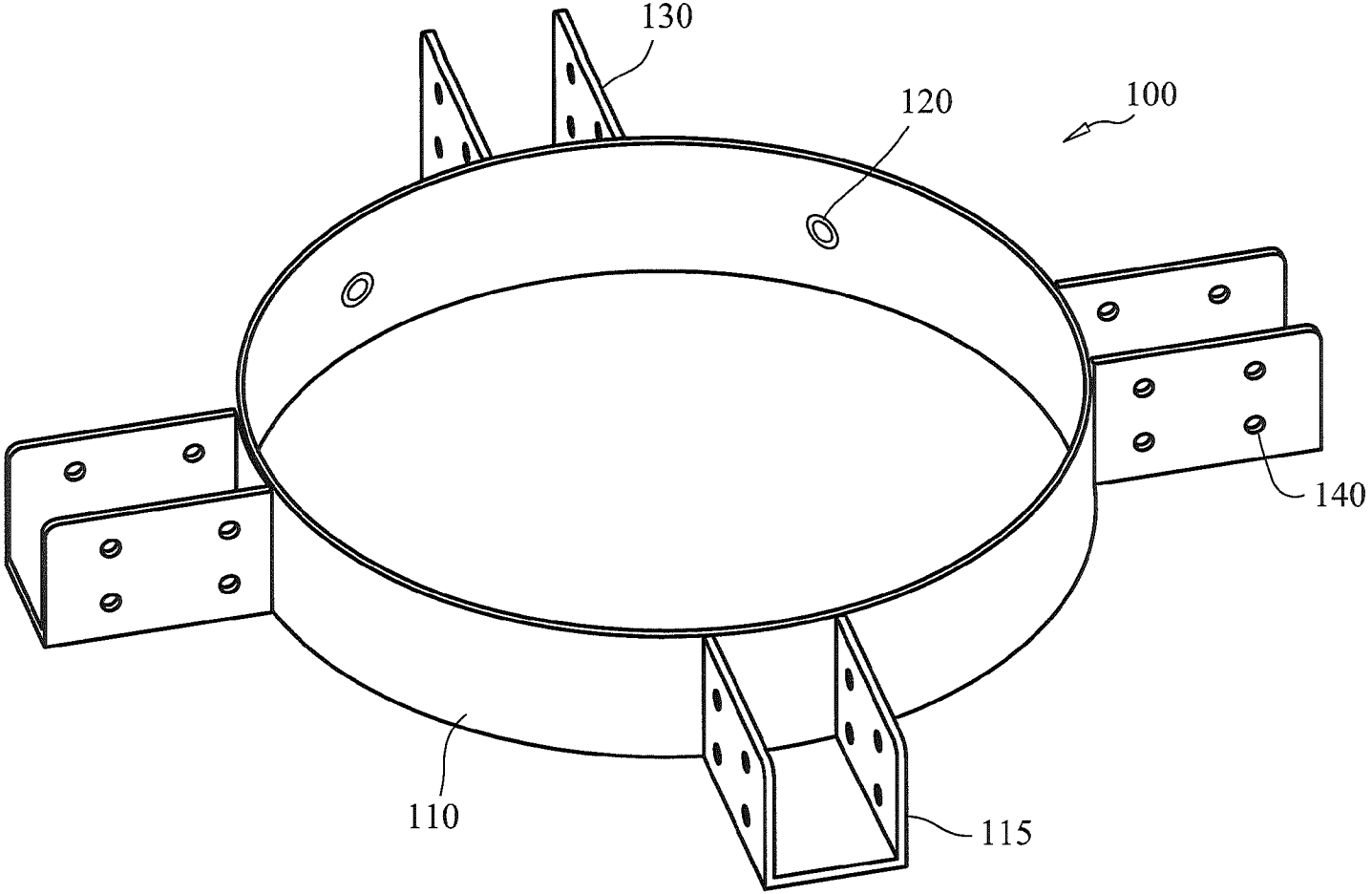
FIG. 1 shows a first embodiment of the invention.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

The instant invention assists with the building of decks, sheds, etc. by the average homeowner or may be used in a commercial construction applications such as bridge work, parking garages, and all industrial construction as well, where columns made of poured concrete that are both above and below grade may be aligned and supported by the instant invention. Concrete columns are use to support structures 80 such as decks, stairs or even buildings such as sheds, garages or even homes in some applications and the concrete column may have a portion below grade. The concrete column is produced by pouring concrete into a tubular concrete column form 90, which must be located precisely to prevent wasted time from removing and re-pouring incorrectly positioned columns. The current method that most concrete column forms 90 are located by both homeowners and professionals is with plumb lines, but incorrect use or loss of tension on the lines may cause improper location of the base or tilting of the top of the form 90 of several inches, which may necessitate removal and re-pouring of the support that causes long delays and expensive rework.

A concrete column form aligning apparatus 100 as shown in FIG. 1 comprises at least two platforms 110 configured to engage a circumference 92 of the concrete column form 90 of the selected diameter concrete column form 90. The concrete column form 90 may be for example a disposable cardboard or plastic tube that varies in diameter for example in inches: 8", 10", 12" or any other size increment including those measured in centimeters or meters that is typically used within that locality with the size chosen for the application being based upon the load that is intended to be supported as specified by the building plans. Each of the diameters of a commonly sold concrete column form 90 may be designed to have a nominal variation of sizes specifically designed by the manufacturer to allow placement of several of the same nominal sized diameter of the disposable forms 90 within each other for reduced delivery costs.

A securing device 120 is used to fix and center the at least two platforms 110 around the circumference 92 of the concrete column form 90. The securing device 120 allows the use of one sized platform 110 to be used on all the nominal variations of the forms 90. The platforms 110 have an interior diameter that is slightly larger than the largest nominal variation of the selected diameter form 90. The securing device 120 may include a biasing device such as a spring and/or a mechanical fastener where the biasing device with the use of a plurality springs would counteract and center the platform 110 about the actual circumference 92 of the concrete column form 90 despite the nominal variation of the various tubes. Once centered the platform 110 may then also be mechanically fastened to prevent movement with the securing device 120 with an item such as a nail, screw, bolt, pin or other type fastener.

Figure 2:
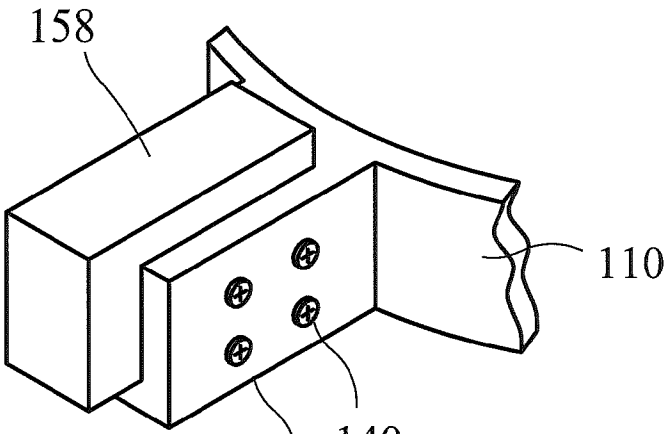
FIG. 2 shows a cutaway view of an attachment bracket.

The platforms 110 has at least one attachment bracket 130 as shown in FIGS. 1 and 2 that is affixed onto each of the at least two platforms 110 affixed at a predetermined angle 116. The platforms 110 having two or more brackets 130 that are spaced evenly apart for example at zero and 180 degrees for two brackets or being positioned at every 90 degrees with four brackets 130. The attachment bracket 130 on one platform 110 is linearly aligned at the correct angle according to the plan with the at least one attachment bracket 130 on the other platform 111. Each attachment bracket 130 has a connector mechanism 140 as shown in FIG. 2 that is cable of allowing engagement of a spacer rod 150 to affix the distance and position between two adjacent platforms 110. The aligning apparatus 100 may use a disposable positioning member 158 cut to a predetermined length secured within said attachment bracket 130 between two adjacent platforms on said column molds as shown in FIG. 2. The disposable positioning member 158 may be a piece of wood of a sufficient length to span between the two adjacent platforms 111 that is measured and cut to length and then secured through the connector mechanism 140 into the two aligned, adjacent brackets 130 on the two adjacent platforms 110.

Figure 18:
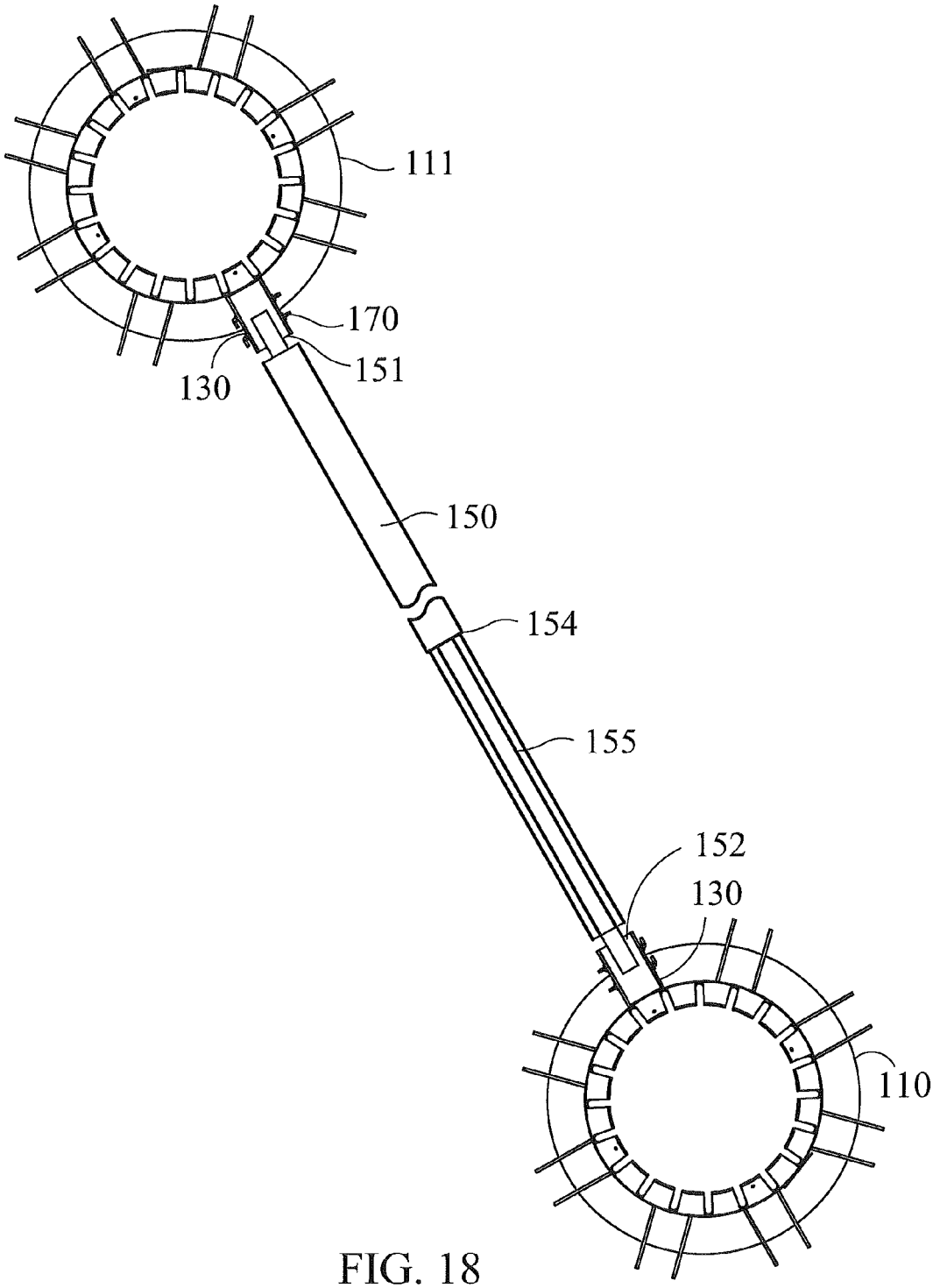
FIG. 18 shows an overhead view of an adjustable rod at a predetermined length attaching two alignment devices.

The aligning apparatus 100 may further comprise an alignment rod 150 having two ends 151, 152 as shown in FIG. 18 attached between two attachment brackets 130. The alignment rod 150 is reusable for many pouring operations. The optional rod 150 may be capable of being length adjusted 154 to a predetermined length 160 and secure said ends 151, 152 of the rod 150 into the attachment brackets 130 between two platforms 110 that are adjacent 111 each other. The length adjustability 154 may be in the form of an inner and outer rod portion that are either threadingly or slidingly engaged to each other to allow movement of the rod 150 to the predetermined length 160 according to the construction plans. The optional rod 150 of the aligning apparatus 100 may further comprise a plurality of measuring marks 155 on said alignment rod 150, wherein the rod 150 is telescopic and locking. The rod 150 may optionally be designed and set up for each specific size form tube centers so that for example a rod designed to span two eight inch diameter tubes would have a measuring system starting at eight inches to account for the distance to the center of both sides. An alternative could be a removable adhesive tape having a measurement system that may be placed upon the rod 150 to account for different column tube diameters. A further option may be to have replaceable, color coded or marked length or adjustable length pivot connectors 165 so that it will be the correct length for 8", 10", 12" or other sized offset having a single marked 155 rod 150 that compensates for different sized forms.

Figure 19:
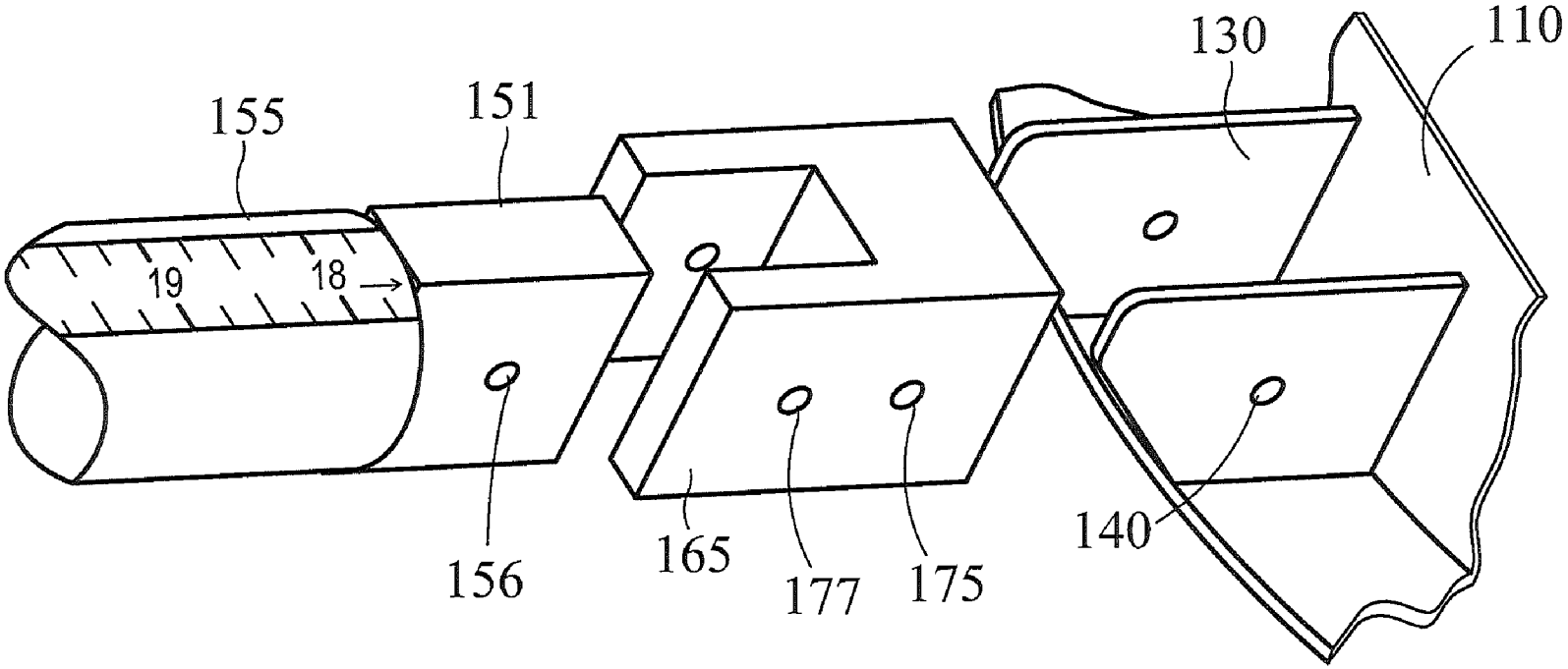
FIG. 19 shows an attachment portion of the adjustable connecting rod.

An additional option of the rod 150 may further comprise a pin 170 configured to releasably retain said alignment rod 150 into each of said attachment brackets 130 affixed on each adjacent platform 111. The rod 150 may include a pivot connector 165 having a fixture hole 175 that connects to the attachment bracket 130 via the connector mechanism 140. The rod end 151 may have a pivot connection 156 that connects to pivot point 177 that allows end 151 to rotate when connected without binding as shown in FIG. 19.

Figure 4:
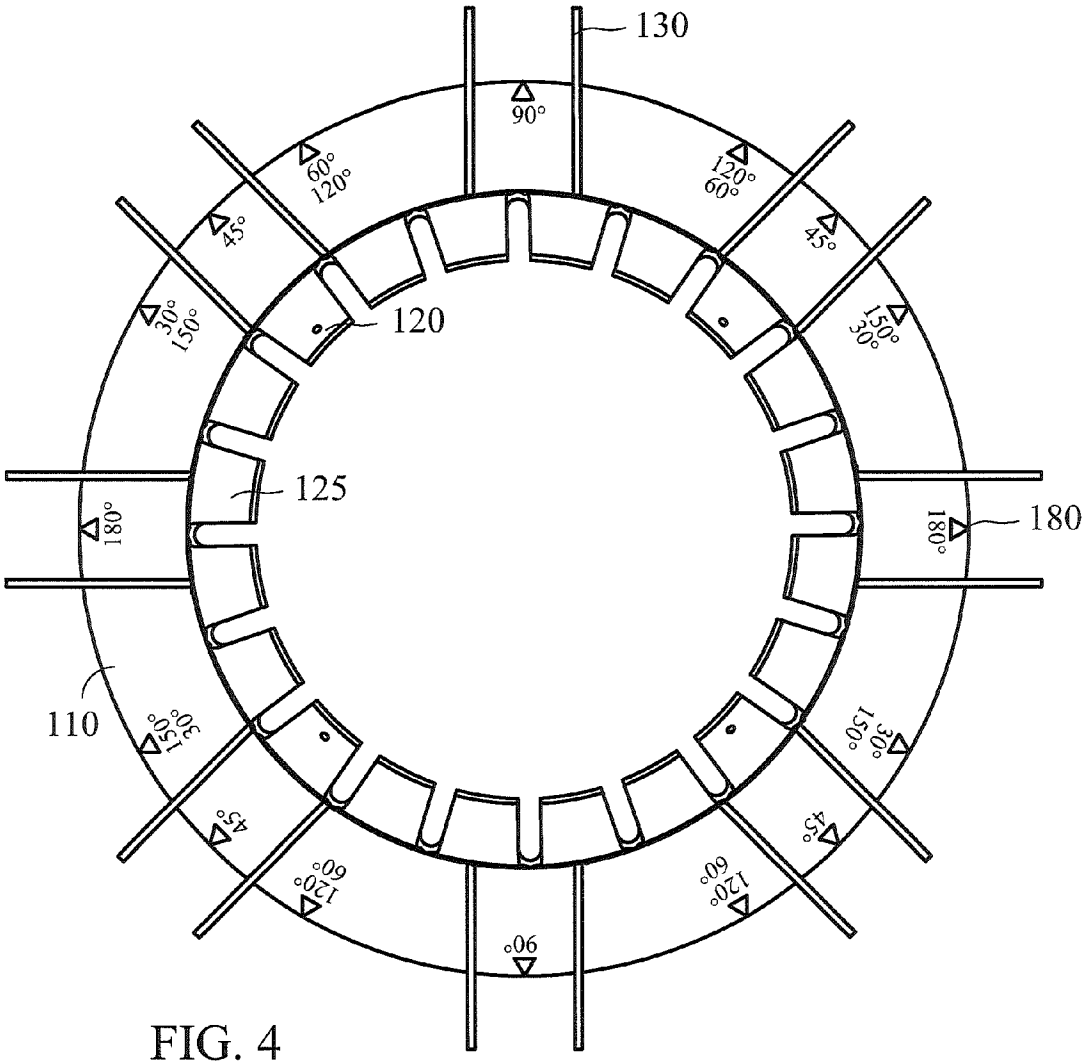
FIG. 4 shows a top view of a second embodiment of the invention.

The aligning apparatus 100 as shown in FIG. 4 may further assist the professional or homeowner builder by further comprising an angular positioning indicator 180 marked from 0-360 degrees printed on each of the platforms 110. The indicators 180 allows the adjacent platforms 111 to be rigidly affixed to the correct angle with respect to each other according to the construction plan. The aligning apparatus 100 may be constructed out of any material such as a sturdy plastic or metal where if an injection molded plastic it can be molded into directly or stamped into the platform if metal.

Figure 3:
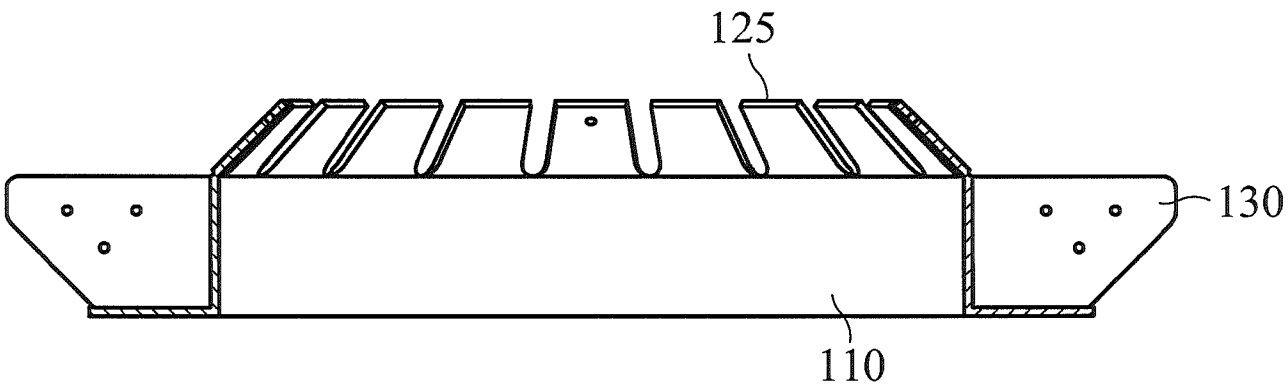
FIG. 3 shows a side view of a second embodiment of the invention.
Figure 6:
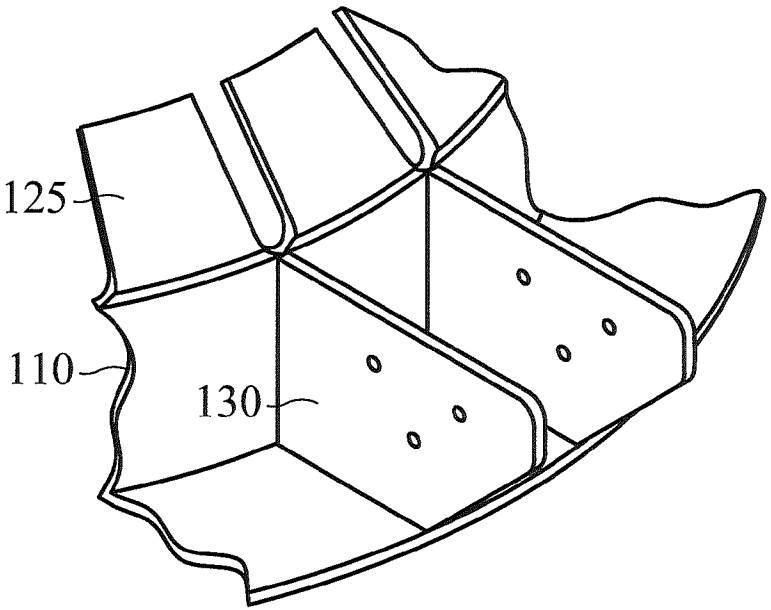
FIG. 6 shows a top perspective view of an attachment device.
Figure 5:
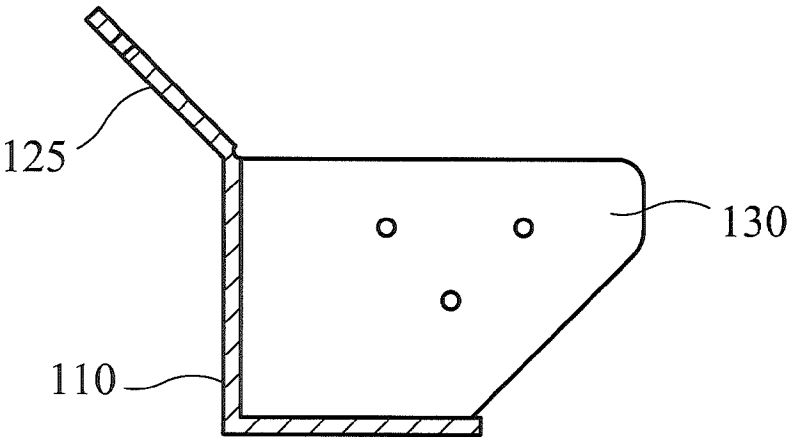
FIG. 5 shows a cross-sectional view of an attachment device.

The aligning apparatus 100 may further comprise a plurality of inward facing tension members 125 attached onto the platform 110 and being configured to contact, center, and align the platform 110 around the circumference 92 of the concrete column form 90 beneath the top as shown in FIG. 6 where the tension members are biased inwards. The inward facing tension members 125 may be a plurality of fingers as shown in FIG. 3 that are configured to be evenly spaced about the body of the tube form. The members 125 are configured to be deflected and under inner tension when surrounding either the smallest or the largest column form 90 as the fingers try to return to the original position it auto centers the apparatus 100. The plurality of fingers 125 may be made of plastic or it could be stamped spring steel as long as it has an elastic body that would be able to produce enough force to center the apparatus 100 around the different nominal diameters of the tubes. The inward facing tension members 125 is shown in FIG. 5 may have an angle of 10-75 degrees with an angle of 45 being displayed and is attached to the top of the platform 110. The inward facing tension members 125 allows placement of the platform 110 at any position along the whole length of the body of the column form 90, whereas other alignment methods required attachment to the top only.

Figure 20:
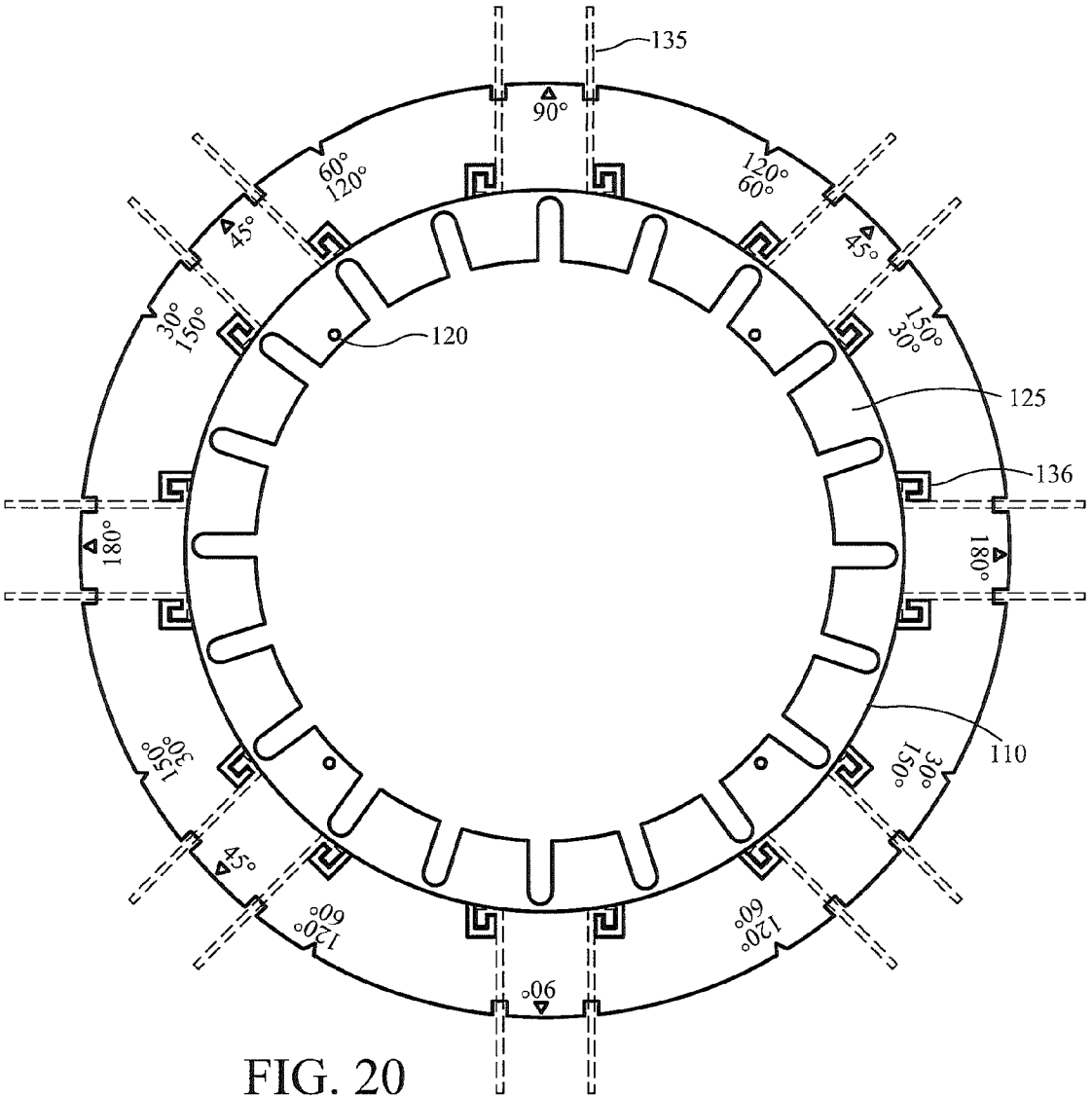
FIG. 20 shows a top view of an alignment device having removable attachment devices.
Figure 22:
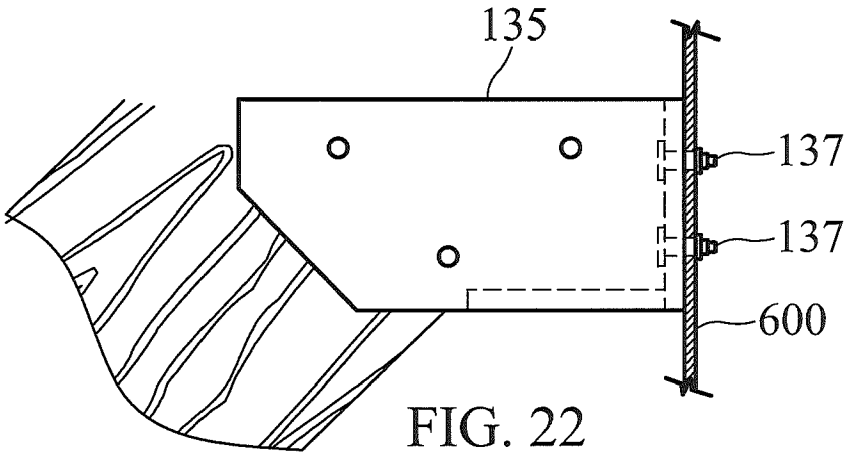
FIG. 22 shows a side view of a moveable attachment bracket with a connecting brace.
Figure 21:
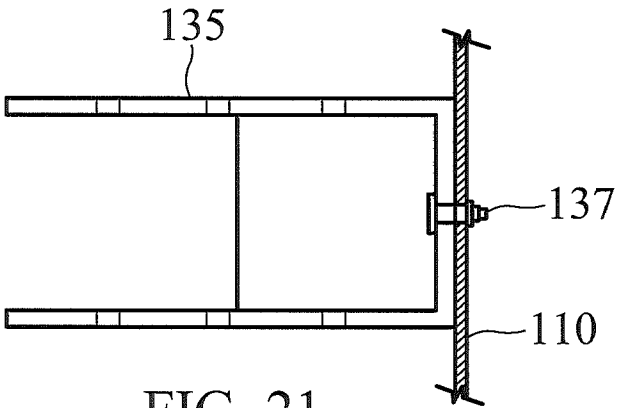
FIG. 21 shows a top view of the moveable attachment bracket.

The aligning apparatus 100 may further comprise a repositionable attachment bracket 135 securable between 0-360 degrees at a predetermined spacing or angles with respect to an attachment bracket 130 affixed on an adjacent platform 111 as shown in FIGS. 20-24. The repositionable bracket 135 may be slid into an appropriate position at the selected angle into the groove 136 as shown in FIG. 20. Once slid into the selected groove 136 the selectable bracket 135 may be fastened onto the platform 110 as shown in FIGS. 21 and 22 by mechanical fasteners 137. An alternative to the fasteners 137 is a snap fit where the bracket 135 is slid into the groove 136 until the catch 139 on the protrusion 138 engages and snap fits into the platform 110.

Figure 11:
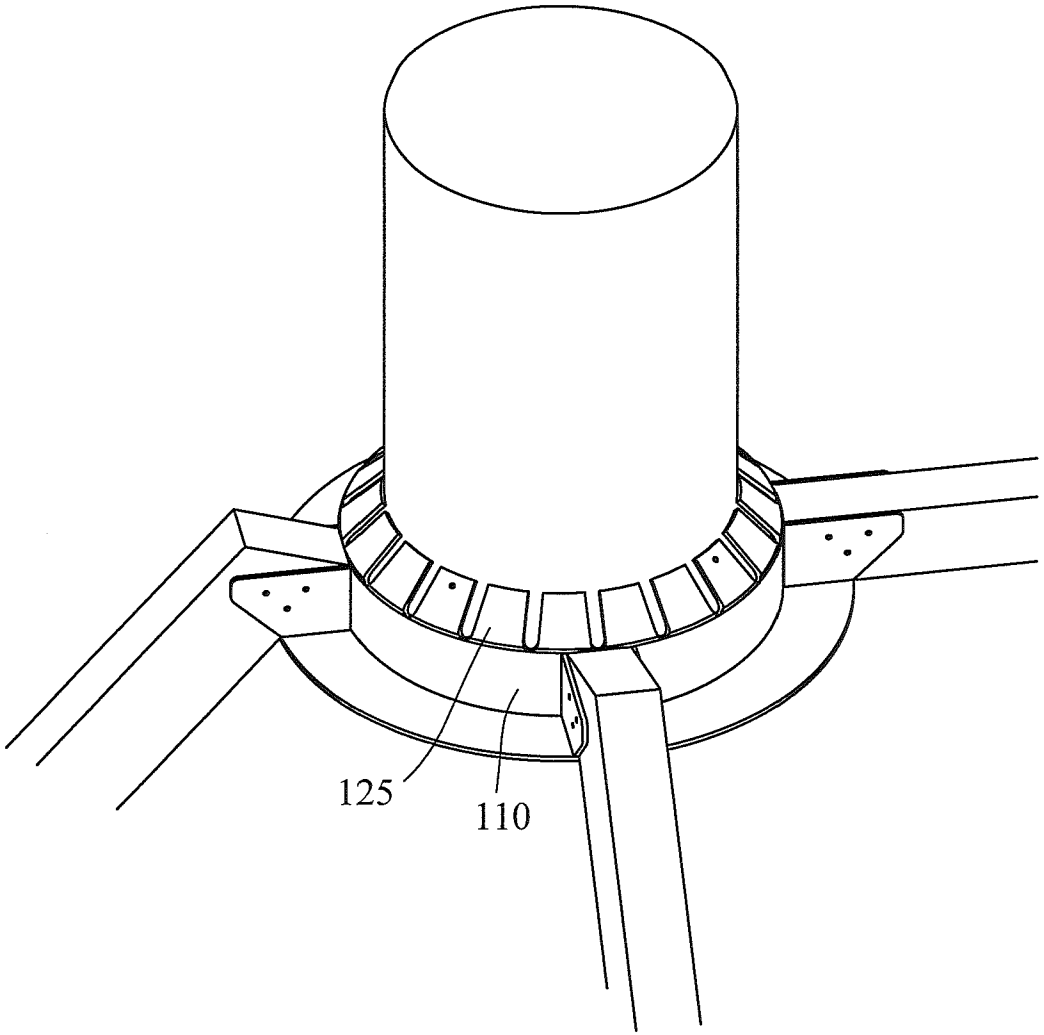
FIG. 11 shows a single alignment tool on a column form.

The aligning apparatus 100 may further comprise a centering ring 125 on the platform 110 substantially parallel to the concrete column form 90. As shown in FIG. 11 a strengthening base 115 perpendicular to said centering ring 125, said base 115 affixed to a bottom portion of said centering ring 125 forming a cylindrical shelf that may stiffen the apparatus 100 to prevent twisting. The aligning apparatus 100 may also further comprise at least four attachment brackets 130 that are permanently affixed between the centering ring 125 and the strengthening base 115 on the platform 110 at an orientation of zero degrees, 90 degrees, 180 degrees and 270 degrees respectively, which are likely to be common angles between adjacent platforms 111.

Figure 8:
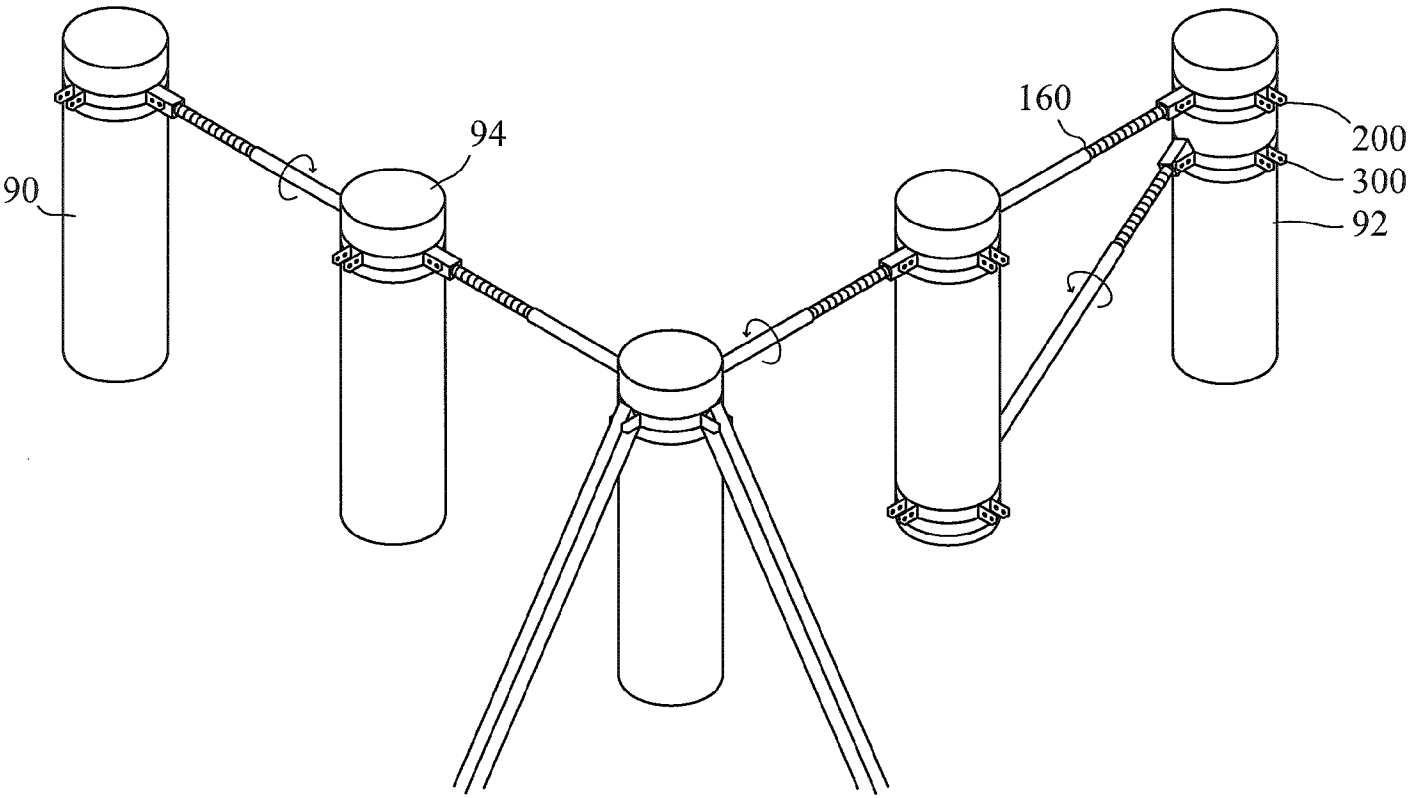
FIG. 8 shows a side view of the invention placed on a plurality of forms.

An aligning apparatus 100 as shown in FIG. 8 is a system that comprises a plurality of rings 200, each said ring dimensioned to surround a circumference 92 of a concrete column forms 90, wherein said form quantity and positioning are designated by one possible example of a complex construction plan 50. The ring 200 has a biasing device 210 as shown in FIG. 12 is present to fix and center each ring 210 by engaging the circumference 92 of the concrete column form 90 beneath a top.

Figure 10:
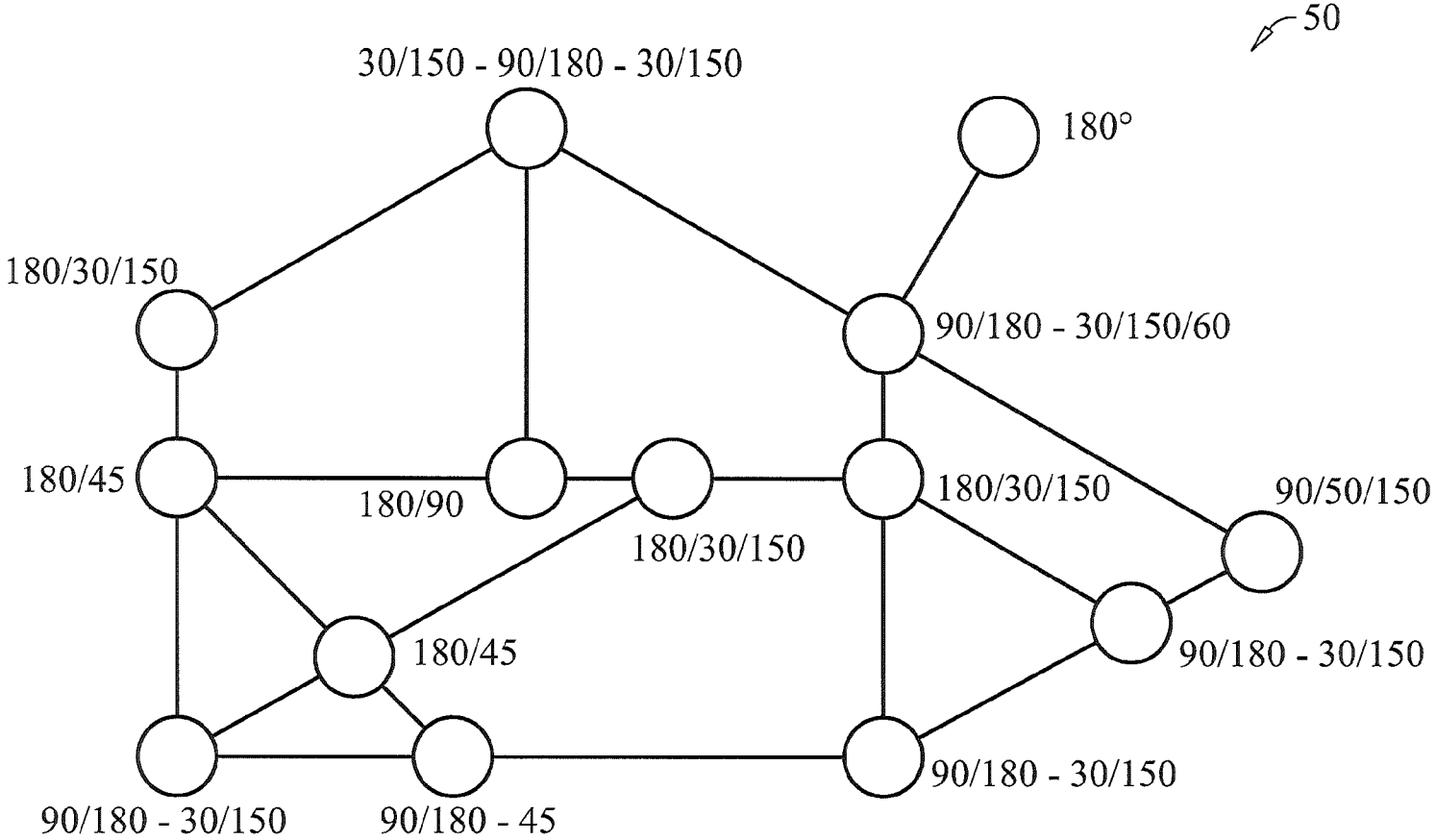
FIG. 10 shows a blueprint layout of a complex support structure.

An aligning apparatus 100 has at least two attachment brackets 220 that are affixed on each of said plurality of rings 200 at a predetermined angle from each other. The rings 200 are rotatable and stackable on said form 90 so that said attachment brackets 220 placed on each said form 90 may be linearly aligned with one of the attachment brackets mounted 220 on the ring 200 upon an adjacent form 94. To align and secure the forms 90 a plurality of connector elements 160 configured to be cut to a desired length and angle to secure between each adjacent form 94 according to said construction plan 50. A sample of a complex construction plan 50 is displayed in FIG. 10 where plumb lines would be very hard to use without risking error except among the most skilled construction worker.

Figure 12:
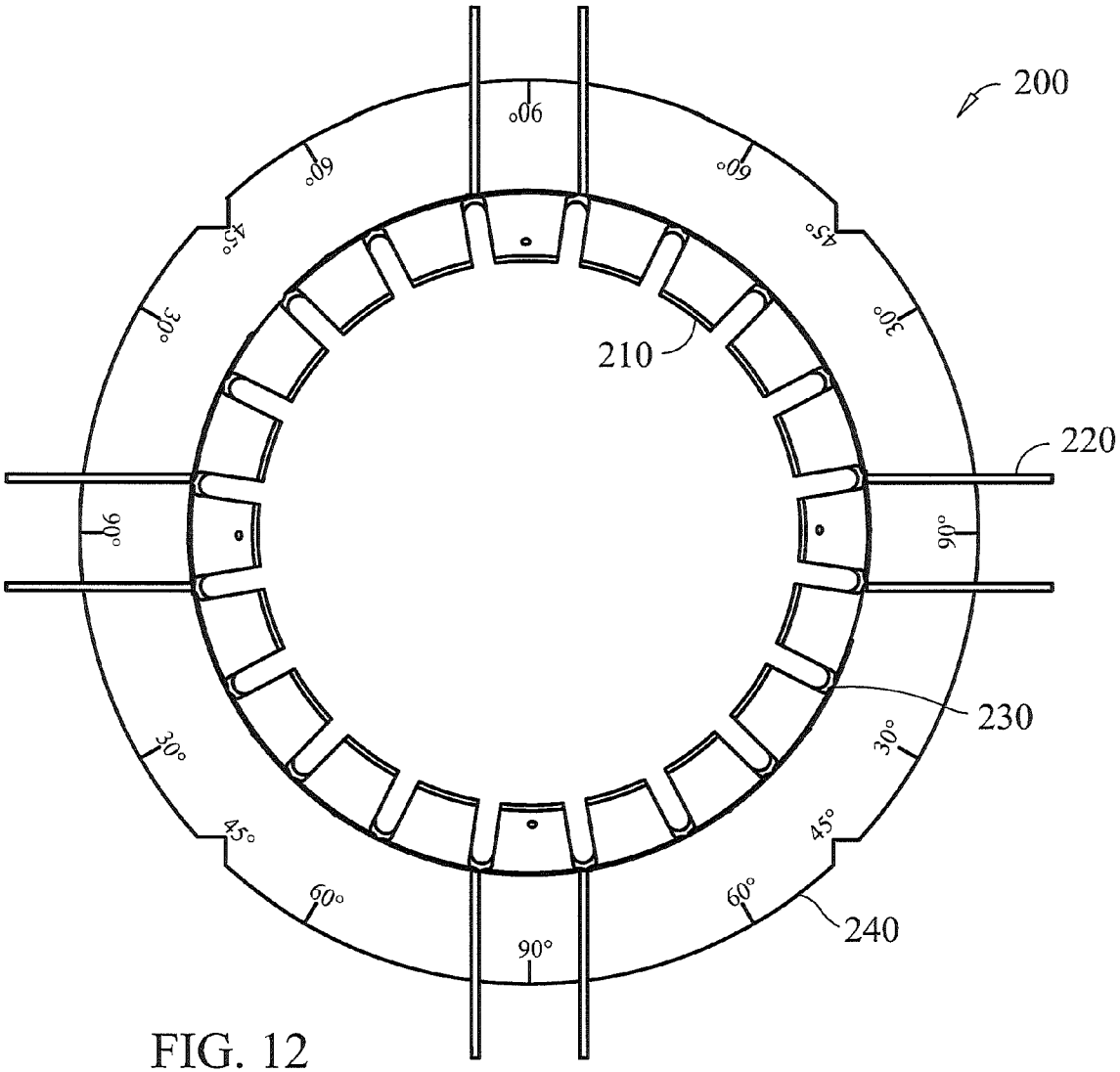
FIG. 12 shows a top view of an embodiment of the tool.

The aligning apparatus 200 may further comprise at least four attachment brackets 220 as shown in FIG. 12 affixed between the centering ring 230 and the strengthening base 240 of each of the ring 200 at an orientation of zero degrees, 90 degrees, 180 degrees and 270 degrees. The aligning apparatus 200 may have the biasing device be a plurality of inward facing tensionable members attached 210 to each ring 230 and contacting the circumference 92 of said form 90.

Figure 24:
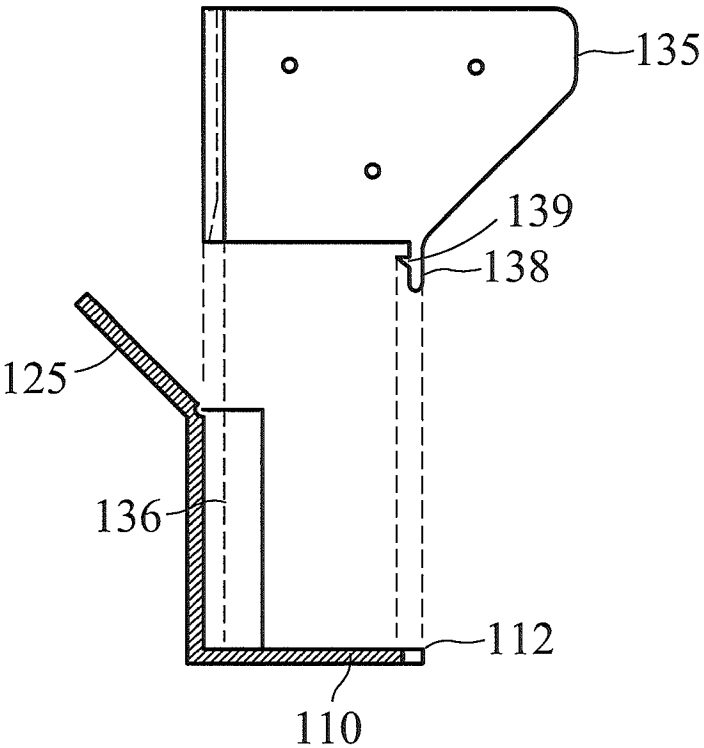
FIG. 24 shows a side cut-away view of a bracket before install into the alignment device.
Figure 23:
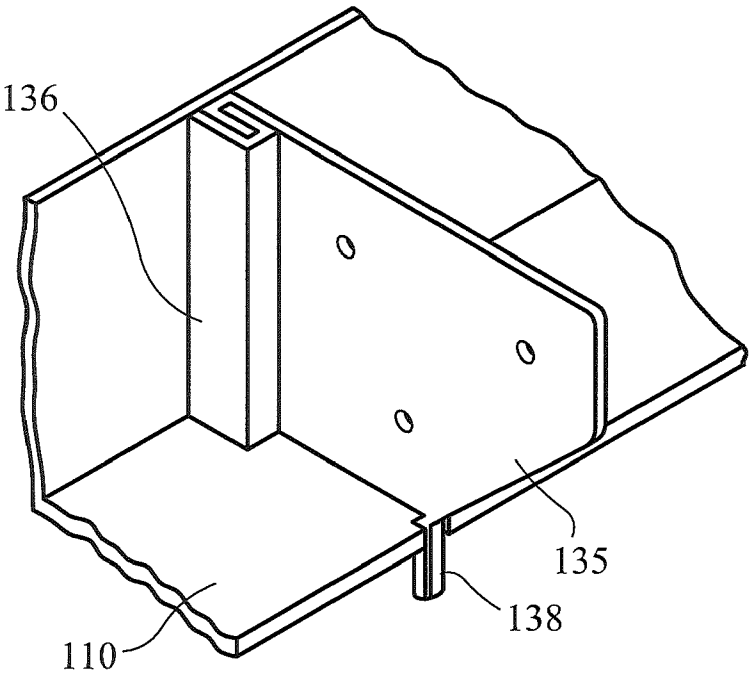
FIG. 23 shows a perspective view of a moveable bracket in the alignment device.

The aligning apparatus 200 may further comprise a strengthening base 240 perpendicular to said ring 200, said base 240 affixed to a bottom portion of said ring 200 forming a cylindrical shelf that the brackets 220 may be secured to for more stability. The base 240 a plurality of openings 112 spaced evenly around said strengthening base 240 as depicted in FIG. 24. For adjustability at least one positionable attachment brackets 135 is configured to be affixed into one of said plurality of openings 112 in said strengthening base 240 at a desired angle.

Figure 7:
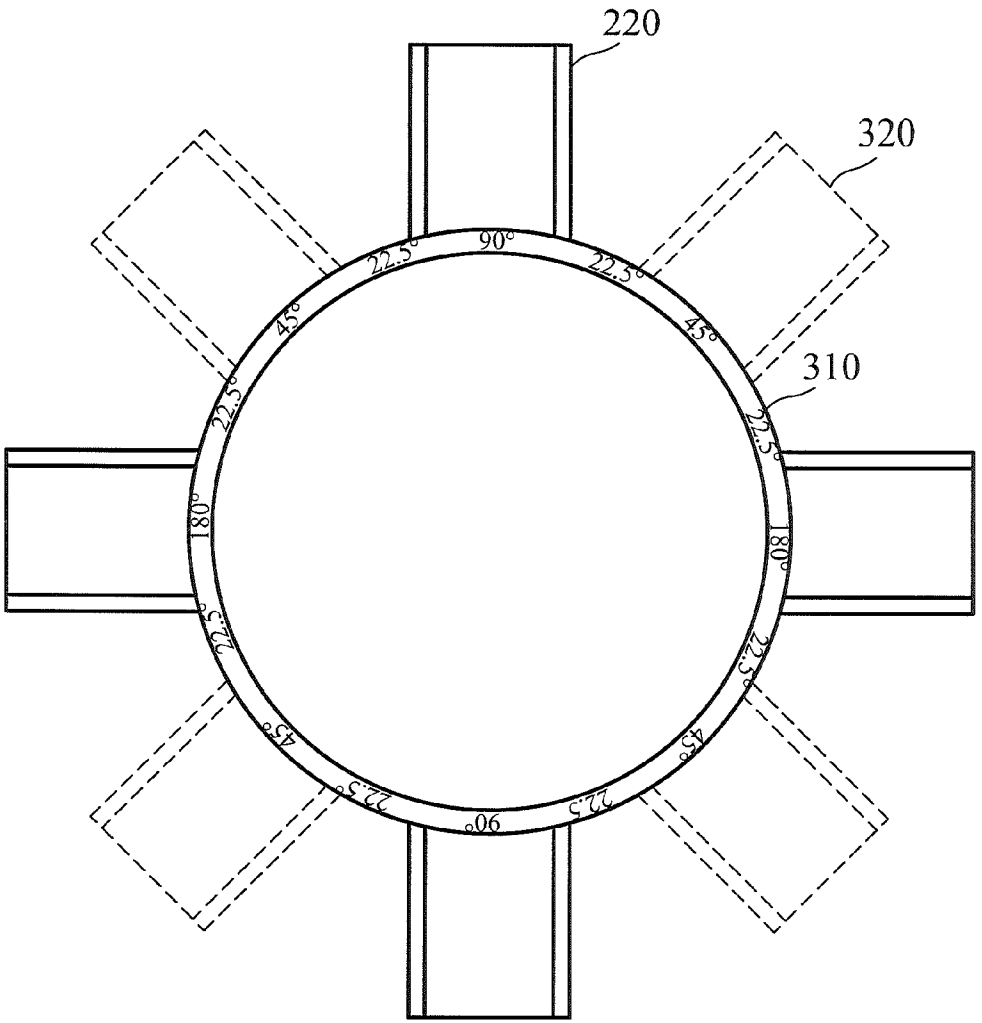
FIG. 7 shows a top view of a second embodiment of the invention in a stacked configuration.

The aligning apparatus 200 may further comprise an angular positioning indicator 310 marked in increments from 0-360 degrees printed on each said plurality of rings 200 and a second stacked ring 300 positioned beneath first ring 200 on said form 90, said second stacked ring 300 is rotated until said affixed bracket is positioned at a desired angle 320 with respect to a first stacked ring 200 as shown in FIGS. 7 and 8. The stacking ring 300 allows use of one ring having four fixed attachment portions 220 at 90 degree increments be used to form any angle required without modifying the ring 200 because it is used as an alignment template by rotating to the correct angle with respect to the upper ring 200.

Figure 13:
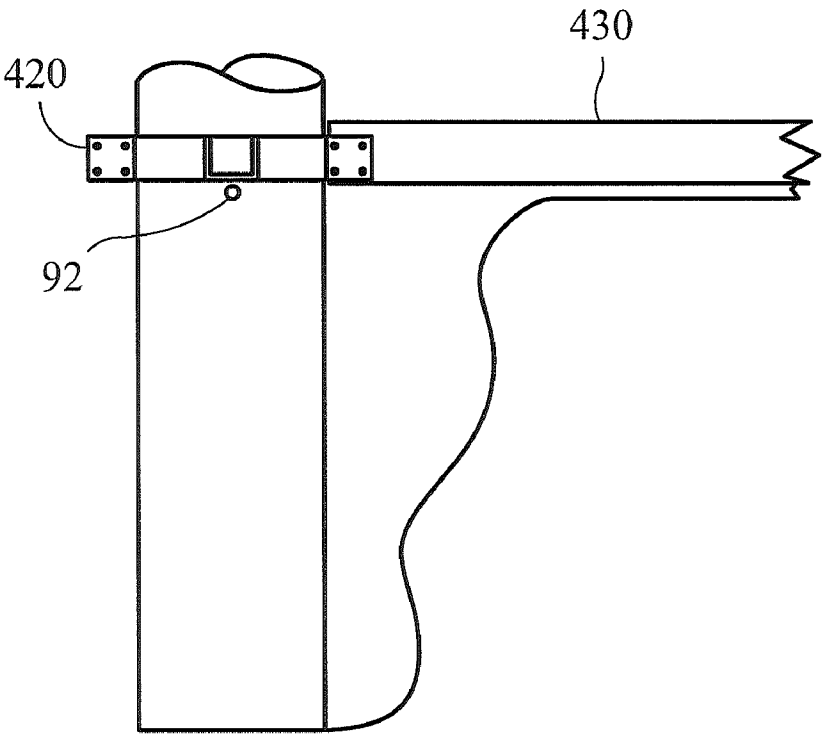
FIG. 13 shows a side view of the device before backfilling.

Another embodiment of the aligning apparatus 400 comprises a plurality of alignment bases 410 dimensioned to surround a circumference of a concrete column form 90 and engaged below the top as shown in FIG. 13. The bases 410 have a biasing device 210 to fix and center said plurality of alignment bases 400 at a point beneath the top of the concrete column form 90. The bases 410 at least four attachment brackets affixed on each of said plurality of alignment bases 410, wherein said brackets 420 are affixed on each said base 410 at a predetermined angle from each other so that one of said at least four attachment brackets 420 may be linearly aligned with one of the brackets 420 mounted on a base 410 upon an adjacent form 93.

Figure 9:
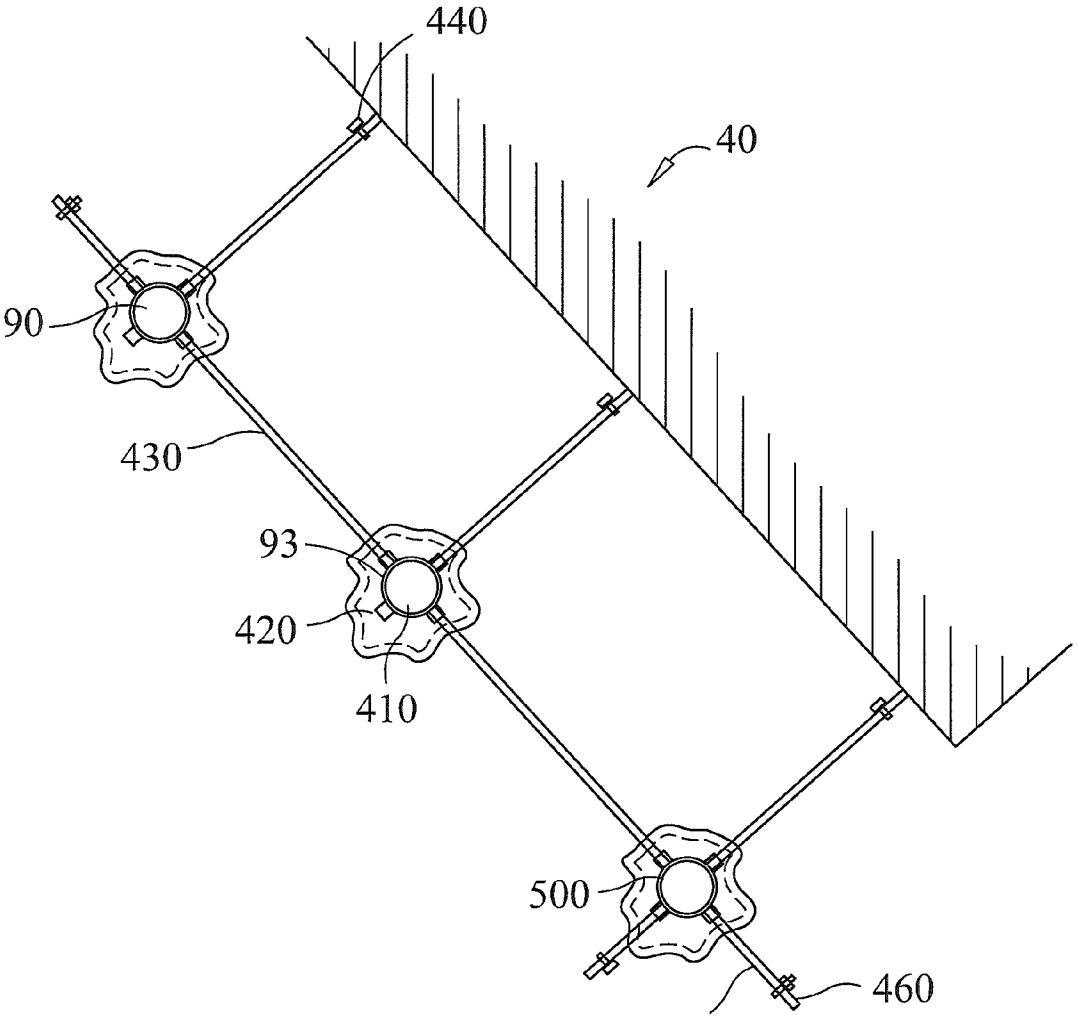
FIG. 9 shows a top view of the invention placed on a plurality of forms and affixed to a building structure.
Figure 14:
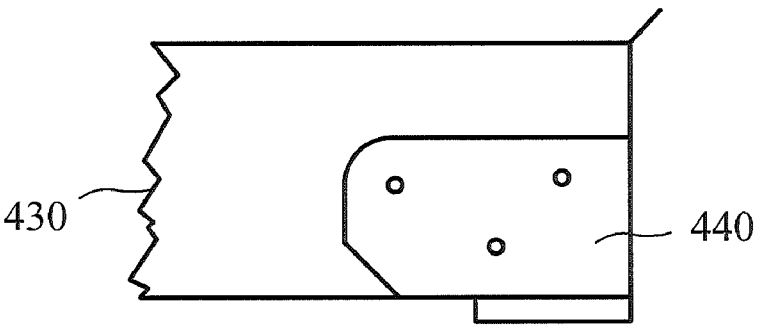
FIG. 14 shows a connecting member affixed in an attachment portion.

The aligning apparatus 400 has a connecting rod 430 having two ends 435, 436 each said end connected into said bracket 420 on an adjacent base 93 that is linearly aligned with respect said bracket. As shown in FIG. 9 the aligning apparatus 400 can be affixed to a structure 40 that may have a bracket 440 as in FIG. 14 secured to align the forms 90 with the pre-existing structure 40 that may be common with the addition of a deck or stairs. The connecting rod 430 may be a one time use member such as a 2×4 wooden brace that is cut to size based upon the plans.

The aligning apparatus 400 may further comprise a stabilization rod 450, said rod 450 is attachable to said attachment bracket 420. A stabilization base 460 attached to said stabilization rod 450 and configured to be staked to the ground. This is an optional feature that can be used with an open and unused attachment bracket 420 when a hole in the ground 500 is present before being backfilled to aid in stability.

Figure 16:
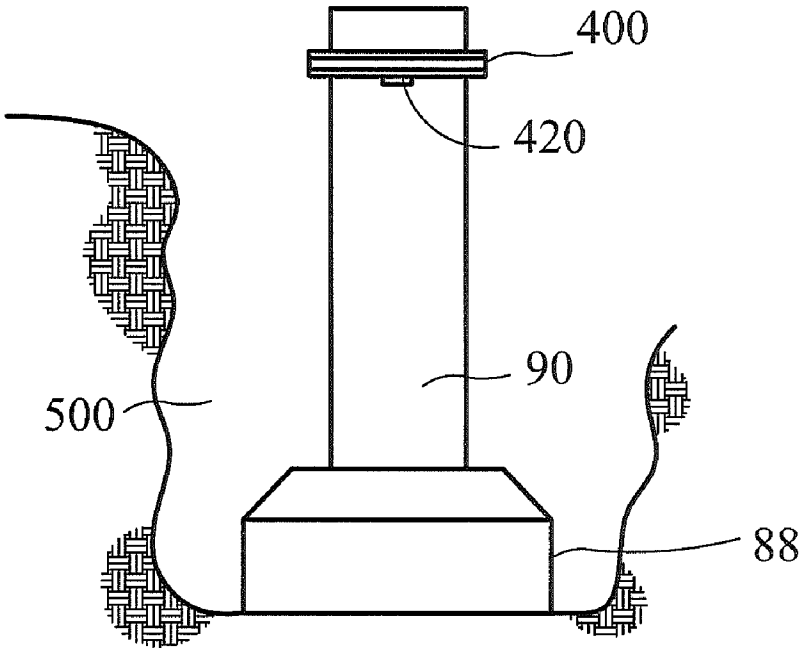
FIG. 16 shows a straight column straight body and a base with the device attached.
Figure 15:
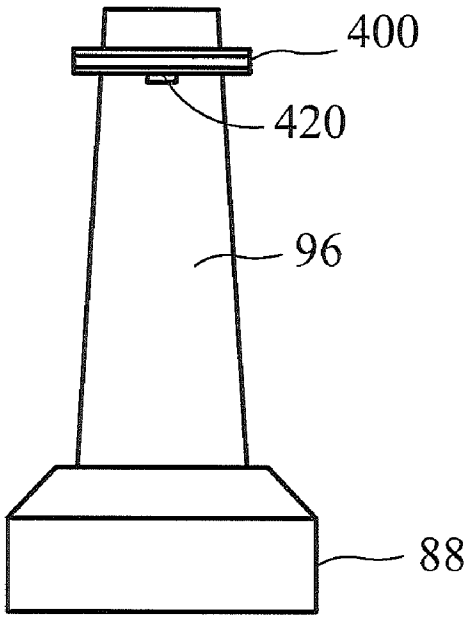
FIG. 15 shows a column having tapered body and a base with the device attached.

The aligning apparatus 400 may be used with a straight column form 90 as shown in FIG. 16 having a base 88 that may be integral or separate shown positioned in a hole in the ground 500 before being backfilled or a form 96 having a tapered body as shown in FIG. 15.

Figure 17:
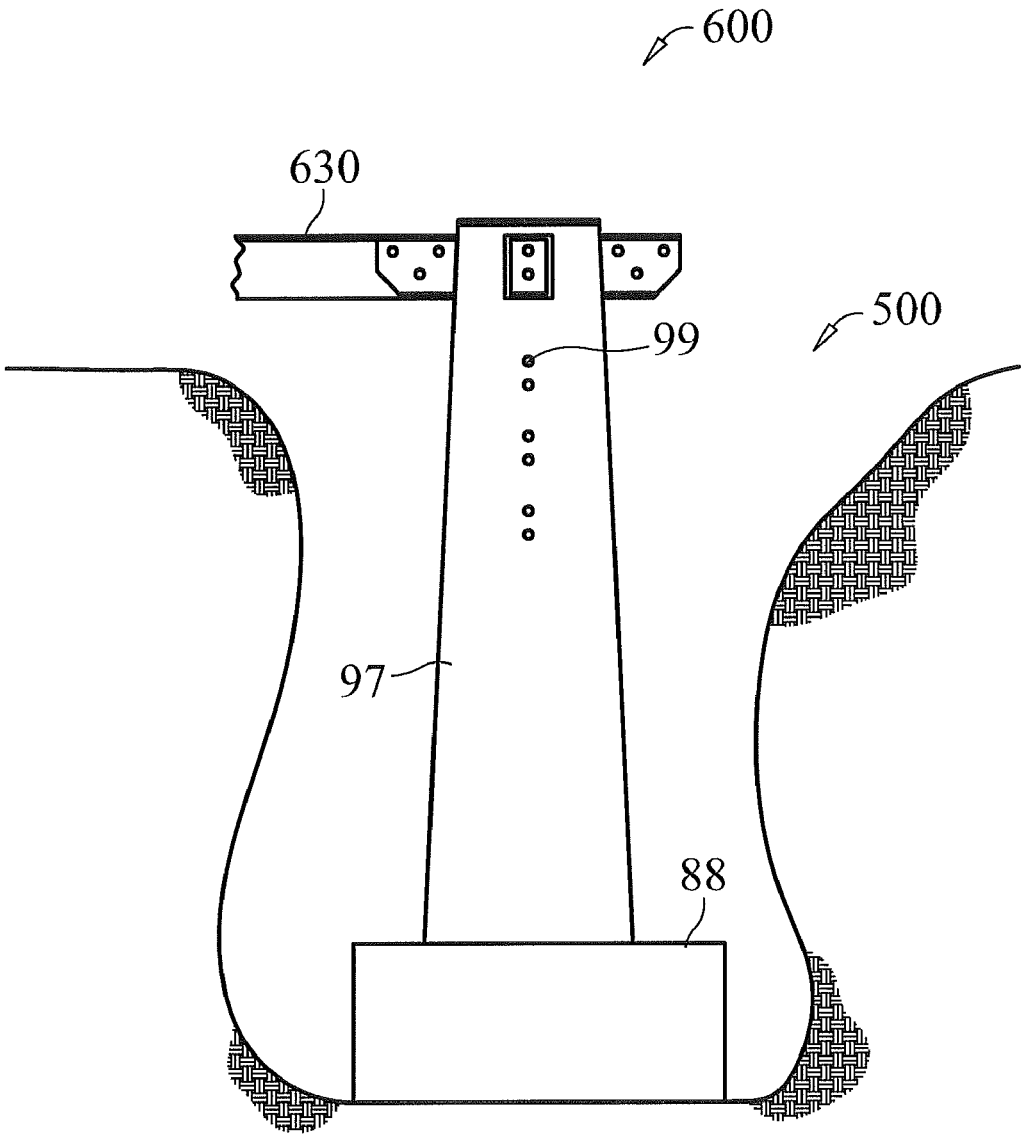
FIG. 17 shows a tapered column with a base before backfill having directly attachable brackets.

An alternative is a form based aligning system 600 where a form 97 has a plurality of attachment holes or indentations 99 surrounding the upper portion of the form 97 that may have an attached or separate form base 88 as shown in FIG. 17. The attachable brackets 135 is shown in FIG. 22 that are secured by mechanical fasteners 137 into attachment portions 99 secured at the proper angles to the form 97. The system 600 is connected by a connection member 630 into the attached bracket 135 between two or more forms 97.

A method of aligning with said aligning apparatus comprising the steps of: providing an aligning apparatus comprising at least two bodies dimensioned to surround the concrete column form below the top, a securing device to fix and center the at least two bodies beneath the top of the concrete column form, at least one attachment bracket affixed on each of the at least two bodies, wherein said at least on attachment bracket is affixed at a predetermined angle so that the at least one attachment bracket is linearly aligned with one of the at least one attachment bracket on the other body, a connector mechanism in said at least one attachment bracket; placing at least one aligning apparatus around each support column mold; determining a proper distance between two adjacent support column molds; selecting an angle on the aligning apparatus between at least two aligning apparatuses; providing a brace at the proper length; and connecting the aligning apparatus with the brace on said attachment bracket at a proper angle and distance between the at least two aligning apparatuses.

The method using the aligning apparatus may further comprising: providing a second aligning apparatus on the same support column mold; rotating the second aligning apparatus to the proper position with respect to the other aligning apparatus on the same support column mold; determining a proper distance and angle between an adjacent support column mold and said second aligning apparatus; providing a brace at the proper length; and securing the brace between an adjacent support column mold and said second aligning apparatus in the attachment brackets. The method further comprising: backfilling the holes in which each of the support columns molds are positioned; pouring cement into the aligned and backfilled support columns molds.

What is claimed is:

1. A concrete column form aligning apparatus comprising:

at least two platforms configured to engage a circumference of the concrete column form;

a securing device to fix and center the at least two platforms around the circumference of the concrete column form;

at least one attachment bracket affixed on each of the at least two platforms affixed at a predetermined angle, wherein said at least one attachment bracket is linearly aligned with one of the at least one attachment bracket on the other platform; and a connector mechanism in said at least one attachment bracket.

2. The aligning apparatus of claim 1 further comprising:

an alignment rod having two ends, said rod capable of being length adjusted to a predetermined length and secure said ends into said at least one attachment bracket affixed on each of the at least two platforms.

3. The aligning apparatus of claim 2 further comprising:

a plurality of measuring marks on said alignment rod, wherein said rod is telescopic and locking.

4. The aligning apparatus of claim 3 further comprising:

a pin configured to releasably retain said alignment rod into each of said attachment brackets affixed on each adjacent platform.

5. The aligning apparatus of claim 1 further comprising:

an angular positioning indicator marked from 0-360 degrees printed on each said at least two platforms.

6. The aligning apparatus of claim 1 further comprising:

a plurality of inward facing tension members attached on each said at least two platforms configured to contact, center, and align the platforms around the circumference of the concrete column form beneath the top.

7. The aligning apparatus of claim 1 further comprising:

a disposable positioning member cut to a predetermined length secured within said attachment bracket between two adjacent platforms on said column molds.

8. The aligning apparatus of claim 1 further comprising:

a repositionable attachment bracket securable 0-360 degrees with respect to said at least one attachment bracket affixed on each of the at least two platforms.

9. The aligning apparatus of claim 1 further comprising:

a centering ring of said at least two platforms substantially parallel to the concrete column form; and a strengthening base perpendicular to said centering ring, said base affixed to a bottom portion of said centering ring forming a cylindrical shelf.

10. The aligning apparatus of claim 9 further comprising:

at least four attachment brackets affixed between the centering ring and the strengthening base of each of the at least two platforms at an orientation of zero degrees, 90 degrees, 180 degrees and 270 degrees.

11. An aligning apparatus comprising:

a plurality of rings, each said ring dimensioned to surround a circumference of a concrete column forms, wherein said form quantity and positioning are designated by a construction plan;

a biasing device to fix and center each said plurality of rings by engaging the circumference of the concrete column form beneath a top;

at least two attachment brackets are affixed on each of said plurality of rings at a predetermined angle from each other, said rings rotatable and stackable on said form so that said attachment brackets on each said form may be linearly aligned with one of the attachment brackets mounted on the ring upon an adjacent form; and a plurality of connector elements configured to be cut to a desired length and angle to secure between each adjacent form according to said construction plan.

12. The aligning apparatus of claim 11 further comprising:

at least four attachment brackets affixed between the centering ring and the strengthening base of each of the at least two bodies at an orientation of zero degrees, 90 degrees, 180 degrees and 270 degrees.

13. The aligning apparatus of claim 11 wherein the biasing device is a plurality of inward facing tensionable members attached to said each ring and contacting the circumference of said form.

14. The aligning apparatus of claim 11 further comprising:

a strengthening base perpendicular to said ring, said base affixed to a bottom portion of said ring forming a cylindrical shelf;

a plurality of openings spaced evenly around said strengthening base; and at least one positionable attachment brackets configured to be affixed into one of said plurality of openings in said strengthening base at a desired angle.

15. The aligning apparatus of claim 12 further comprising:

an angular positioning indicator marked in increments from 0-360 degrees printed on each said plurality of rings; and a second stacked ring positioned beneath first ring on said form, said second stacked ring rotated until said affixed bracket is positioned at a desired angle with respect to a first stacked ring.

16. An aligning apparatus comprising:

a plurality of alignment bases dimensioned to surround a circumference of a concrete column form and engaged below the top;

a biasing device to fix and center said plurality of alignment bases at a point beneath the top of the concrete column form;

at least four attachment brackets affixed on each of said plurality of alignment bases, wherein said brackets are affixed on each said ring at a predetermined angle from each other so that one of said at least four attachment brackets may be linearly aligned with one of the brackets mounted on a base upon an adjacent form; and a connecting rod having two ends, each said end connected into said bracket on an adjacent base that is linearly aligned with respect said bracket.

17. The aligning apparatus of claim 16 further comprising:

a stabilization rod, said rod attachable to said attachment bracket; and a stabilization base attached to said stabilization rod and configured to be staked to the ground.

* * * * *